United States Patent [19]

Brison

[11] Patent Number: 4,677,749

[45] Date of Patent: Jul. 7, 1987

[54] BLADE SET FOR AN ELECTRICAL KNIFE

[75] Inventor: Marc P. Brison, Saint-Lô , France

[73] Assignee: Moulinex, Societe Anonyme, Bagnolet, France

[21] Appl. No.: 814,737

[22] Filed: Dec. 30, 1985

[30] Foreign Application Priority Data

Jan. 30, 1985 [FR] France ..... 85 01286

[51] Int. Cl.[4] ..... B26B 9/02

[52] U.S. Cl. ..... 30/355; 30/272 A

[58] Field of Search ..... 30/210, 229, 241, 272 A, 30/355; 83/838, 854, 855

[56] References Cited

U.S. PATENT DOCUMENTS 2,750,669 6/1956 Hohmann ..... 30/355
3,418,713 12/1968 Bauer ..... 30/272 A
3,488,845 1/1970 Tausehdfreondt ..... 30/355

FOREIGN PATENT DOCUMENTS 93713 12/1938 Sweden ..... 83/835

*Primary Examiner*—Douglas D. Watts
*Attorney, Agent, or Firm*—Young & Thompson

[57] ABSTRACT

A blade set for an electrical knife comprises two parallel extending blades arranged adjacent with their inner faces facing and joined to one another. In use, for example, for slicing bread, the two blades are alternately reciprocated by the drive motor of the knife. Each blade has a series of indentations in its lower edge between which projecting teeth are defined. The tip of each tooth has a small concave notch, in the form of a circular arc, which extends between the edges of the tooth and which has a chamfer. The ends of this notch form two spaced points.

8 Claims, 5 Drawing Figures

BLADE SET FOR AN ELECTRICAL KNIFE

BACKGROUND TO THE INVENTION

The present invention relates to a blade set intended for equipping an electrical knife, and in particular to a blade set designed for slicing foodstuffs, such as bread.

It is known to provide for an electrical knife a blade set having two adjacent blades arranged in parallel vertical planes and joined to one another along their inner face. Each blade has on its lower edge a series of indentations which define projecting teeth. These blades are arranged to be alternately reciprocated.

Conventional blades of this type are well suited to the slicing of soft foodstuffs, such as, for example, meat, but are unsuitable for slicing other relatively hard foodstuffs, such as bread which has a firm crust on a body consisting of relatively soft crumbs.

It is an object of the invention to provide a solution to this problem.

SUMMARY OF THE INVENTION

According to the invention there is provided a blade set for an electrical knife, said blade set comprising first and second elongate blades, each of said blades having an elongate inner face, an elongate outer face, and elongate top and bottom edges each joining said inner and outer faces, said first and second blades being arranged to extend in respective parallel planes with their inner faces facing towards each other and being joined together, wherein each of said first and second blades has a plurality of indentations in its bottom edge defining a series of projecting teeth, each tooth having two side edges defining a projecting tip, and wherein a respective concave notch is formed in the projecting tip of a plurality of said teeth, each said notch being arranged to define, together with the side edges of the respective tooth, two points at the tip of said tooth.

A blade set of the invention is well suited to the slicing of bread. In fact, it combines the conventional slicing and shearing effect for the crumb with a planing effect for the bread crust which results from the addition of the pair of points at the end of each tooth.

The invention also extends to a blade set for an electrical knife, said blade set comprising first and second elongate blades, each of said blades having an elongate inner face, an elongate outer face, and elongate top and bottom edges each joining said inner and outer faces, said first and second blades being arranged to extend in respective parallel planes with their inner faces facing towards each other and being joined together, wherein each of said first and second blades has a plurality of indentations in its bottom edge defining a series of projecting teeth, each tooth having two side edges defining a projecting tip, wherein each said indentation has a chamfer extending from the innner face to the outer face of the blade which defines a cutting edge on the inner face, and wherein a respective concave notch is formed in the projecting tip of each said tooth, each said notch being arranged to define, together with the side edges of the respective tooth, two points at the tip of said tooth and wherein each said notch is chamfered in the direction from the inner face of the blade to the outer face of the blade.

BRIEF DESCRIPTION OF THE DRAWINGS

An embodiment of the present invention will hereinafter be described, by way of example, with reference to the accompanying drawing, in which.

DESCRIPTION OF A PREFERRED EMBODIMENT

Figure 1:
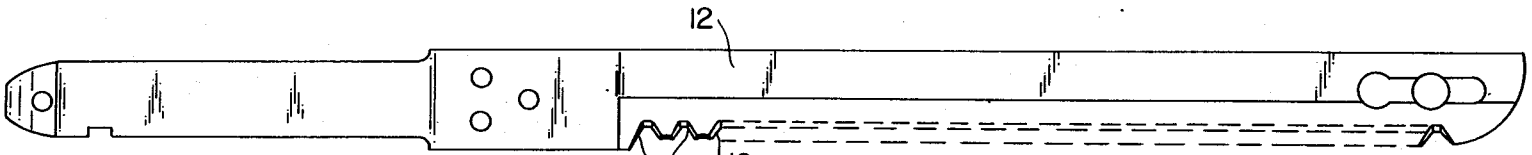
FIG. 1 shows, in elevation, a blade set of the invention.
Figure 2:
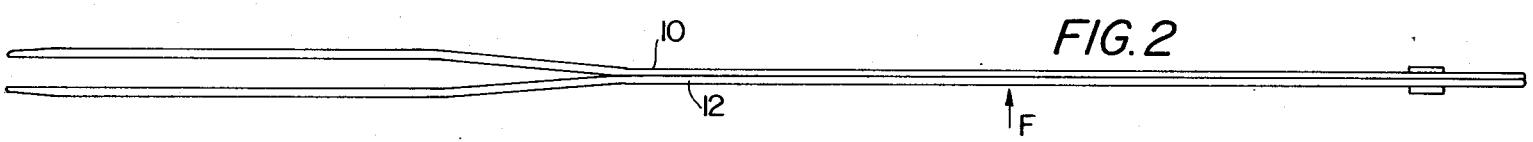
FIG. 2 is a plan view of the blade set of FIG. 1.

The blade set illustrated is intended to be used with an electrical knife having a motor for alternately reciprocating two parallel slides each receiving one of the blades.

The blade set comprises two adjacent blades 10 and 12 arranged in parallel vertical planes and joined to one another along their inner faces 14. Each of these blades 10 and 12 has, in its lower edge 16, a series of indentations 18 between which projecting teeth 20 are defined.

The base of each recess or indentation 18 has a chamfer 21 which extends from the inner face 14 of the blade to its outer face 22 and which also forms a cutting edge 24 located on the inner face 14. the tip of each tooth 20 has a small notch 26 in the form of a circular arc, which is concave downwardly, and which extends between the chamfered edges 27 of the tooth. The notch 26 itself has a chamfer 28 extending from the inner face 14 of the blade to its outer face 22. The ends of this notch 26 form together with the edges 27 of the tooth 20, two points, 30 and 32, which are close to one another.

Figure 3:
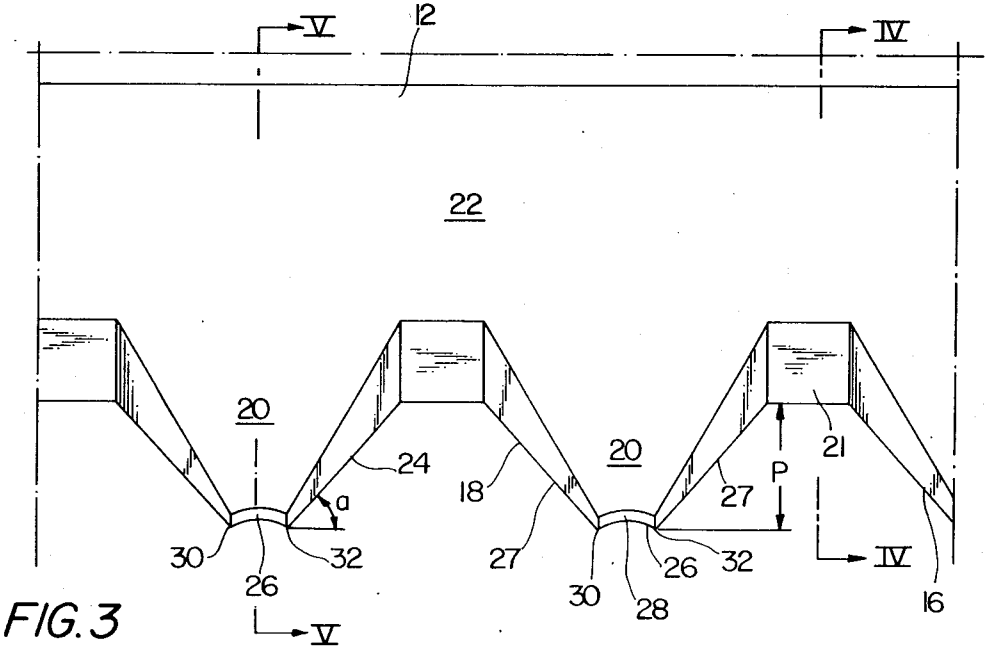
FIG. 3 is an elevation view on a larger scale of part of the toothing of a blade seen in the direction of arrow F of FIG. 2.

As can be seen clearly in FIG. 3, each indentation 18 has the general shape of an isosceles trapezium. An angle a defined between each side of the trapezium and a line aligned across the lower points 30, 32 of the blade is of the order of fifty degrees. The width of a small notch 26 measured from one point 30 to the other point 32 is of the order of one fifth of the width of an indentation 18. For example, the width of the notch 26 could be of the order of one millimeter, and the width of the indentation 18 would then be five millimeters. The depth P of each indentation 18 is, for example, between two and three millimeters.

Figure 4:
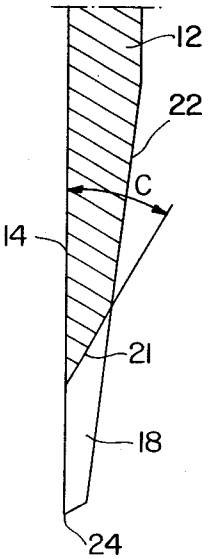
FIG. 4 is a vertical section through the toothing of a blade taken along the line IV—IV of FIG. 3.
Figure 5:
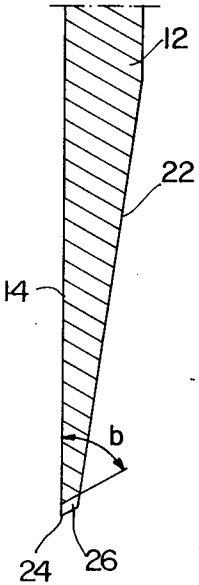
FIG. 5 is a section of a blade taken along the line V—V of FIG. 3.

As shown in FIGS. 4 and 5, the thickness of each blade, 10, 12 decreases towards the lower ends of the teeth 20. An angle b between the inner face 14 of the blade and the chamfer 28 of the small notch 26 is greater than an angle c defined between this inner face 14 and the chamfer 21 of the bottom of the indentation 18. For example, the angle b is of the order of sixty degrees, whereas the angle c is of the order of thirty degrees.

As will be appreciated, when the blades 10 and 12 are driven alternately in opposite directions by the motor of the electrical knife, a slicing effect arises, caused by the chamfered indentations 18. In addition, there is also a planing effect from the points 30 and 32 of the small notch 26.

I claim:

1. A blade set for an electrical knife, said blade set comprising first and second elongate blades, each of said blades having an elongate inner face, an elongate outer face, and elongate top and bottom edges each joining said inner and outer faces, said first and second blades being arranged to extend in respective parallel planes with their inner faces facing towards each other and being joined together, each of said first and second blades having a plurality of indentations in its bottom edge defining a series of projecting teeth, each tooth having two side edges defining a projecting tip, a respective concave notch being formed in the projecting tip of a plurality of said teeth, each said notch being arranged to define, together with the side edges of the respective tooth, two points at the tip of said tooth, each indentation having a chamfer which extends from the inner face to the outer face of the blade and defines a cutting edge on said inner face, and each said notch being also chamfered in the direction from the inner face of the blade to the outer face of the blade, the angle between the inner face of the blade and the chamfer of the indentations being less than the angle between the inner face of the blade and the chamfer of said notches.

2. A blade set according to claim 1, wherein the angle between the inner face of the blade and the chamfer on an indentation is of the order of thirty degrees at the bottom of the indentation, and wherein the angle between the chamfer on a notch and the inner face of the blade is of the order of sixty degrees.

3. A blade set according to claim 1, wherein the thickness of each blade between the inner and outer faces thereof decreases toward the projecting tips of the said teeth.

4. A blade set according to claim 1, wherein the width of each said notch from one said point thereof to the other said point is of the order of one fifth of the width of a said indentation.

5. A blade set according to claim 4, wherein the width of each said notch is of the order of one millimeter, and the width of each said indentation is of the order of five millimeters.

6. A blade set according to claim 5, wherein the depth of each said indentation is between two and three millimeters.

7. A blade set according to claim 1, wherein each said indentation has the general form of an isosceles trapezium.

8. A blade set according to claim 7, wherein the angle between each side of the trapezium and a straight line containing said points of the notch is of the order of fifty degrees.

* * * * *